US007204441B1

(12) United States Patent
Hartnett et al.

(10) Patent No.: US 7,204,441 B1
(45) Date of Patent: Apr. 17, 2007

(54) SHREDDER APPARATUS AND FULL BIN INDICATOR

(75) Inventors: David G. Hartnett, Carol Stream, IL (US); Au Yeung Ping Fai, Chai Wan (HK)

(73) Assignee: Fellowes Inc., Itasca, IL (US)

( * ) Notice: Subject to any disclaimer, the term of this patent is extended or adjusted under 35 U.S.C. 154(b) by 0 days.

(21) Appl. No.: 11/482,125

(22) Filed: Jul. 7, 2006

(51) Int. Cl.
*B02B 7/02* (2006.01)

(52) U.S. Cl. ..... 241/100; 241/101.3

(58) Field of Classification Search ..... 241/33, 241/36, 236, 100, 101.3; 270/908
See application file for complete search history.

(56) References Cited

U.S. PATENT DOCUMENTS 2,899,140 A * 8/1959 Hellyer ..... 241/190
3,882,770 A 5/1975 Bleasdale
4,650,128 A 3/1987 Goldhammer
5,102,057 A 4/1992 Ellis, III
5,167,374 A 12/1992 Strohmeyer
5,310,229 A 5/1994 Hanson
5,375,701 A 12/1994 Hustad et al.
5,464,162 A 11/1995 Kusters
5,772,130 A * 6/1998 Toschi ..... 241/30
5,897,065 A 4/1999 Schwelling
5,934,504 A 8/1999 Elliott
6,978,954 B2 12/2005 Kroger et al.

FOREIGN PATENT DOCUMENTS

DE 100 32 069 2/2002

* cited by examiner

*Primary Examiner*—Faye Francis
(74) *Attorney, Agent, or Firm*—Pillsbury Winthrop Shaw Pittma LLP

(57) ABSTRACT

A shredder apparatus is provided that may include a bin for receiving shredded materials and a shredder housing that contains a shredder mechanism. The shredder housing is configured to be seated upon the bin and to provide a bin access opening to allow for the deposit of articles into the bin when the shredder housing is seated upon the bin. A movable member is pivotally connected to the bin side of the shredder housing and is configured to rotate such that a portion of a visual indicator is visible by a user.

19 Claims, 5 Drawing Sheets

SHREDDER APPARATUS AND FULL BIN INDICATOR

FIELD OF THE INVENTION

The present invention relates to shredder apparatuses and, more particularly, to shredder apparatuses having a mechanical and cost-effective full bin indicator flap.

BACKGROUND OF THE INVENTION

Conventional full bin indicators for shredder apparatuses typically require some sort of electronic component in order to alert a user that the bin is full. One such device utilizes an infrared signal to recognize the accumulation of bin contents. Another device involves a mechanical flap that actuates an electronic switch when the bin has reached capacity.

Full bin indicators having electronic components tend to be expensive and are prone to electrical failure. A mechanical full bin indicator in accordance with the present invention provides a cost-effective way of alerting a user when a shredder bin has reached capacity.

SUMMARY OF THE INVENTION

In accordance with an embodiment of the present invention, a shredder apparatus is provided that comprises a bin for receiving shredded materials and a shredder housing having a shredder mechanism mounted therein. The shredder housing is provided on the bin and comprises an input opening on an upper side for receiving materials to be shredded and an output opening on a lower side for depositing shredded material into the bin. A movable member is movably connected to the shredder housing and extends into the bin. The movable member is positioned such that an accumulation of shredded material in the bin engages the movable member and moves it in an indicating direction. The movable member has a mechanical visual indicator associated therewith. Movement of the movable member in the indicating direction by the accumulation of shredded material moves the visual indicator in view of a user exterior of the shredder apparatus to visually indicate the accumulation to the user.

In accordance with a further embodiment of the present invention, a shredder apparatus is provided that comprises a shredder mechanism and a housing containing the shredder mechanism. The housing has an input opening on an upper side for receiving materials to be shredded and an output opening on a lower side for depositing shredded material. A movable member is movably connected to the shredder housing and is positioned such that an accumulation of shredded material engages the movable member and moves it in an indicating direction. The movable member has a mechanical visual indicator associated therewith. Movement of the movable member in the indicating direction by the accumulation of shredded material moves the visual indicator in view of a user exterior of the shredder apparatus to visually indicate the accumulation to the user.

In accordance with a further embodiment of the present invention, a method is provided for indicating accumulation of shredded material from a shredder in a bin. Material to be shredded is fed into an input opening in a housing of the shredder and a shredding mechanism in the shredding housing shreds the fed material. The shredded material is deposited into the bin and accumulates therein. The accumulating shredded material engages a movable member movably that is mounted to the shredder housing and that extends into the bin to move the movable member in an indicating direction. The movable member has a visual member associated therewith, and movement of the movable member in the indicating direction by the accumulation of shredded material moves the visual indicator to visually indicate the accumulation to a user.

Other objects, features, and advantages of the present invention will become apparent from the following detailed description, the accompanying drawings, and the appended claims.

BRIEF DESCRIPTION OF THE DRAWINGS

The above-mentioned and other features and advantages of this disclosure, and the manner of attaining them, will become more apparent and the disclosure itself will be better understood by reference to the following description taken in conjunction with the accompanying drawings, wherein.

Figure 1:
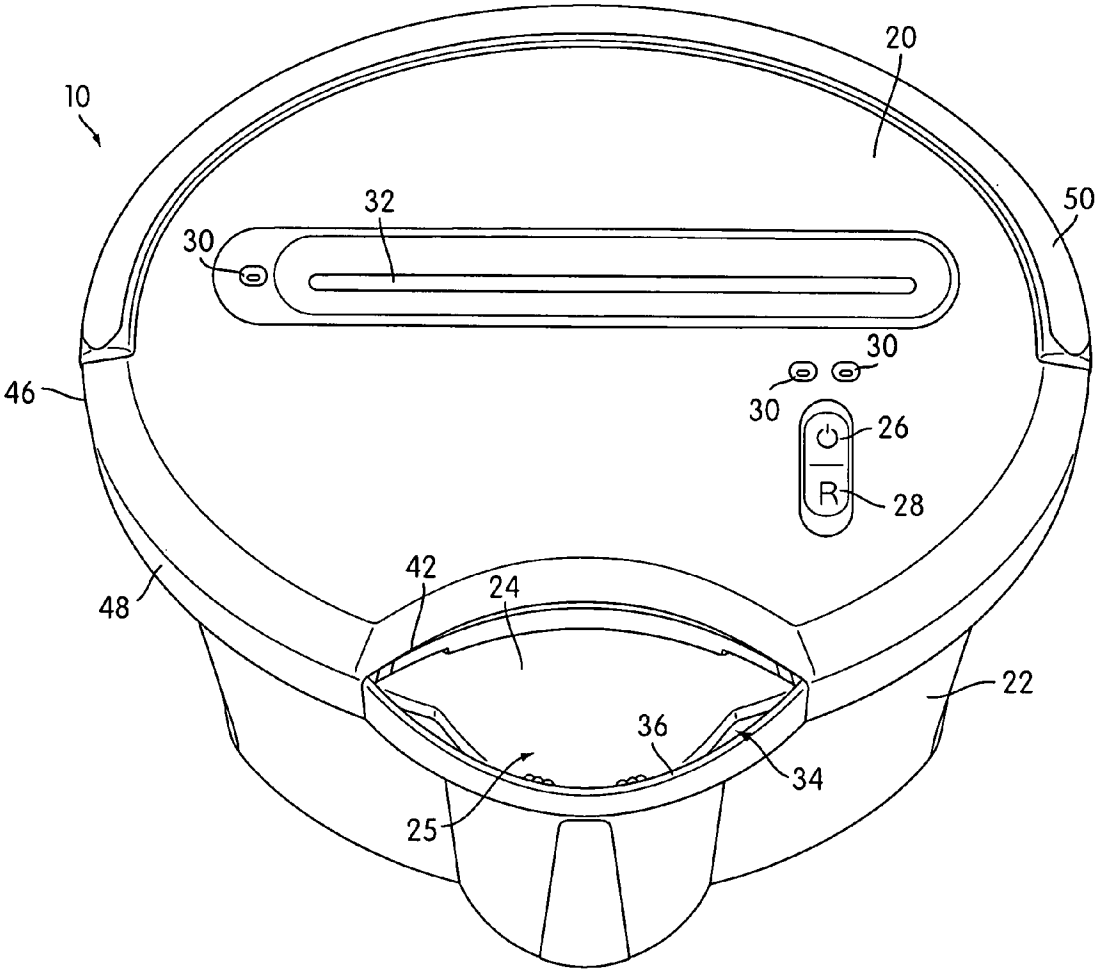
FIG. 1 is a top perspective view of a shredder apparatus having a full bin indicator in accordance with an embodiment of the present invention.

An embodiment will be described with reference to the accompanying drawings. Corresponding reference characters indicate corresponding parts throughout the several views. The description as set out herein illustrates an arrangement of an embodiment of the present disclosure and is not to be construed as limiting its scope in any manner.

DETAILED DESCRIPTION OF THE INVENTION

FIG. 1 illustrates a shredder apparatus 10 having a full bin indicator 24 in accordance with an embodiment of the present invention. The apparatus 10 generally includes a shredder housing 20, a bin 22, and an indicator 24. In the embodiment shown, the indicator 24 is a flap attached to the bin side (underside) of the shredder housing 20 and has an extended portion 25.

FIG. 1 shows a view of the shredder housing 20 from the top. As shown, the shredder housing 20 is situated upon the bin 22 so that materials inserted into a shredder opening 32 will be shredded and deposited directly into the bin 22. The shredder housing 20 may have a lip 46 or other structural arrangement that corresponds in size and shape with a top edge 48 of the bin 22. In the embodiment shown, the shredder housing 20 and bin 22 are sized such that all but a portion 34 of the entire bin opening is covered by the shredder housing 20. This opening 34 is a bin access opening that may be utilized to deposit articles (e.g., trash) that are not desired to be shredded. The shredder housing 20 may optionally be provided with a cutout 42 that increases the size of the bin access opening 34 in order to accommodate larger articles. The bin 22 may optionally be provided with an extension portion 36 to likewise increase the size of the bin access opening 34. Naturally, at least one of a cutout 42 in the shredder housing 20 or an extension portion 36 in the bin 22 is preferred, so as to form the bin access opening 34.

Alternatively, the bin 22 and the shredder housing 20 be may an integral component. In such a case, shredded materials within the bin portion of the apparatus may be removed via a door located on the bin portion and/or the shredder housing portion. All other features of an integral bin/housing configuration relevant to the present invention may be as described herein.

The configuration of the bin access opening 34 and its location relative to the shredder input opening 32 (also commonly referred to as the throat) is not particularly critical, and the invention is not limited to the configuration disclosed. For example, the bin access opening need not be provided in part by the bin, and instead may be an opening through the shredder housing 20 itself. Likewise, it may be entirely provided by an opening formed through the structure of the bin. Furthermore, in some embodiments of the present invention there may be no bin access opening present. Instead, the bin 22 and/or shredder housing 20 may be provided with a window through which the indicator 24 may be viewed. In other embodiments, the indicator 24 may be operably connected to or have a secondary element that is otherwise viewable from the exterior of the shredder apparatus 10 without requiring a bin access opening 34 or a window (e.g., a mechanical element that moves or otherwise changes its appearance that is connected to the indicator 24 through the shredder housing, or a mechanical gauge that is operably connected to the indicator 24).

Although the shredder housing 20 and bin 22 are shown as nesting in a complementary fashion, one of skill in the art will appreciate that such a complementary fit is not a requirement of the present invention. The present invention may be applied in apparatuses in which the shape of the shredder housing 20 greatly varies from that of the bin 22 (e.g., in cases where a shredder housing in accordance with the present invention is used with a pre-existing or generic receptacle).

The top of the shredder housing 20 may include a switch or plurality of switches to control operation of the shredder apparatus 10. As shown in FIG. 1, a rocker switch is provided on the shredder housing that includes a power button portion 26 and a reverse button portion 28. Indicator lights 30 are also provided. The power button portion 26 turns the shredder apparatus 10 on and off. The reverse button portion 28 may be used to clear a jam when materials get stuck in the shredder machinery by reversing the feed direction. It is appreciated that any switches known in the art may be used for these purposes within the scope of the invention. The indicator lights 30 may indicate various operations and/or statuses associated with the shredder apparatus 10. The shredder housing 20 may further be provided with a handle 50 to facilitate removal from and placement onto the bin 22.

Figure 2:
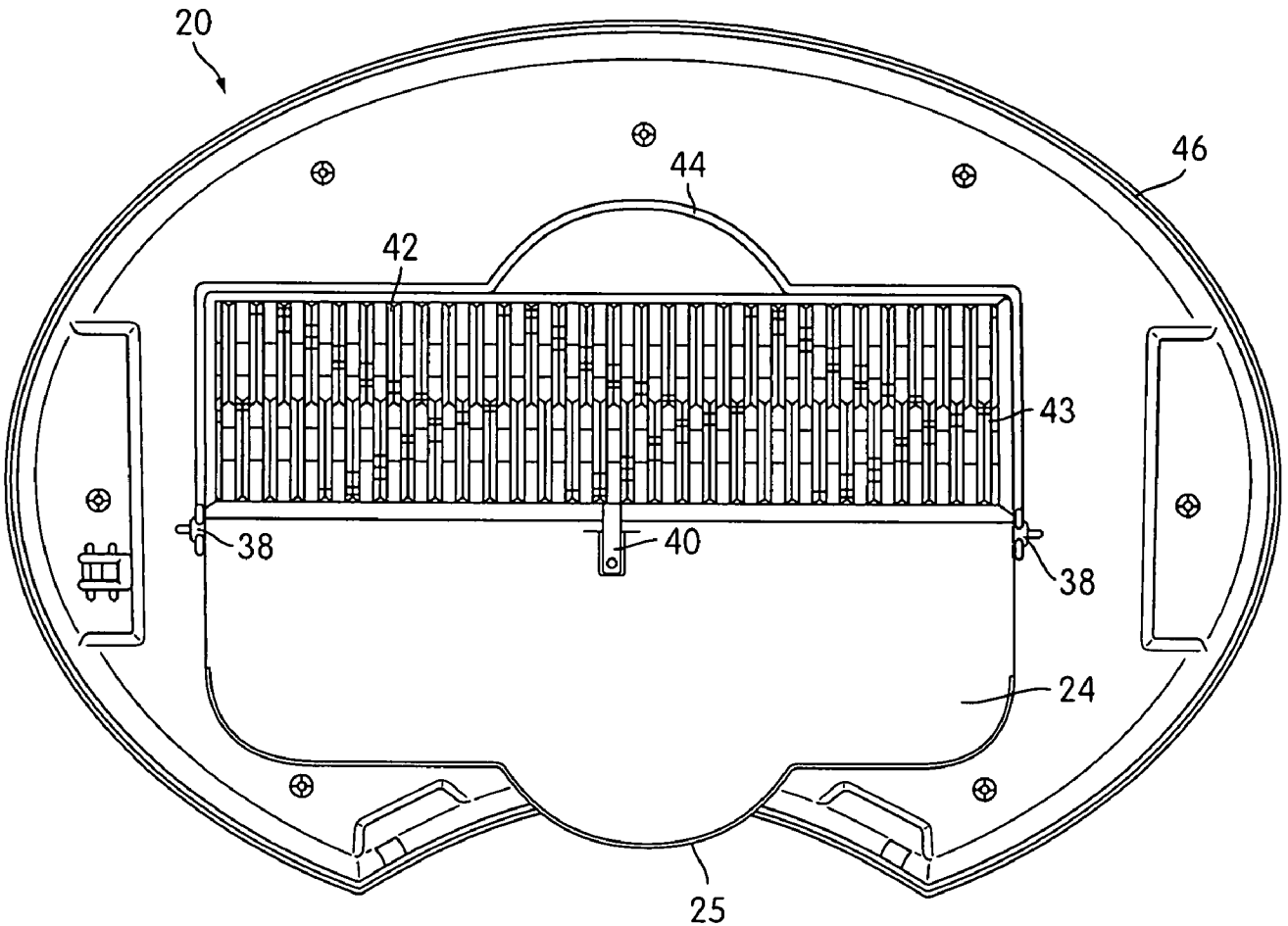
FIG. 2 is a bottom view of a shredder housing in a first configuration in accordance with an embodiment of the present invention.

The bin side (underside) of the shredder housing 20 is shown in FIG. 2. As is known in the art, the shredder machinery 42, including blades configured to shred inserted materials, is configured to receive inserted materials and to feed them through the device and to eject or deposit the shredded pieces of the materials into the bin 22. The shredding machinery 42 therefore has an input opening at 32 and an output opening 43 at the bottom of the housing, as shown in FIG. 2. The top of the shredder housing 20 having an opening for the shredding machinery input 32 may be considered an "input side." The bin side, or underside, of the shredder housing 20 may be considered an "output side."

The shredder housing 20 and bin 22 may be designed for use together, or the shredder housing 20 may be designed to mount to pre-existing bins owned by a user, such as waste-baskets, trash cans, and the like. The particular construction is not intended to be limiting.

Figure 4:
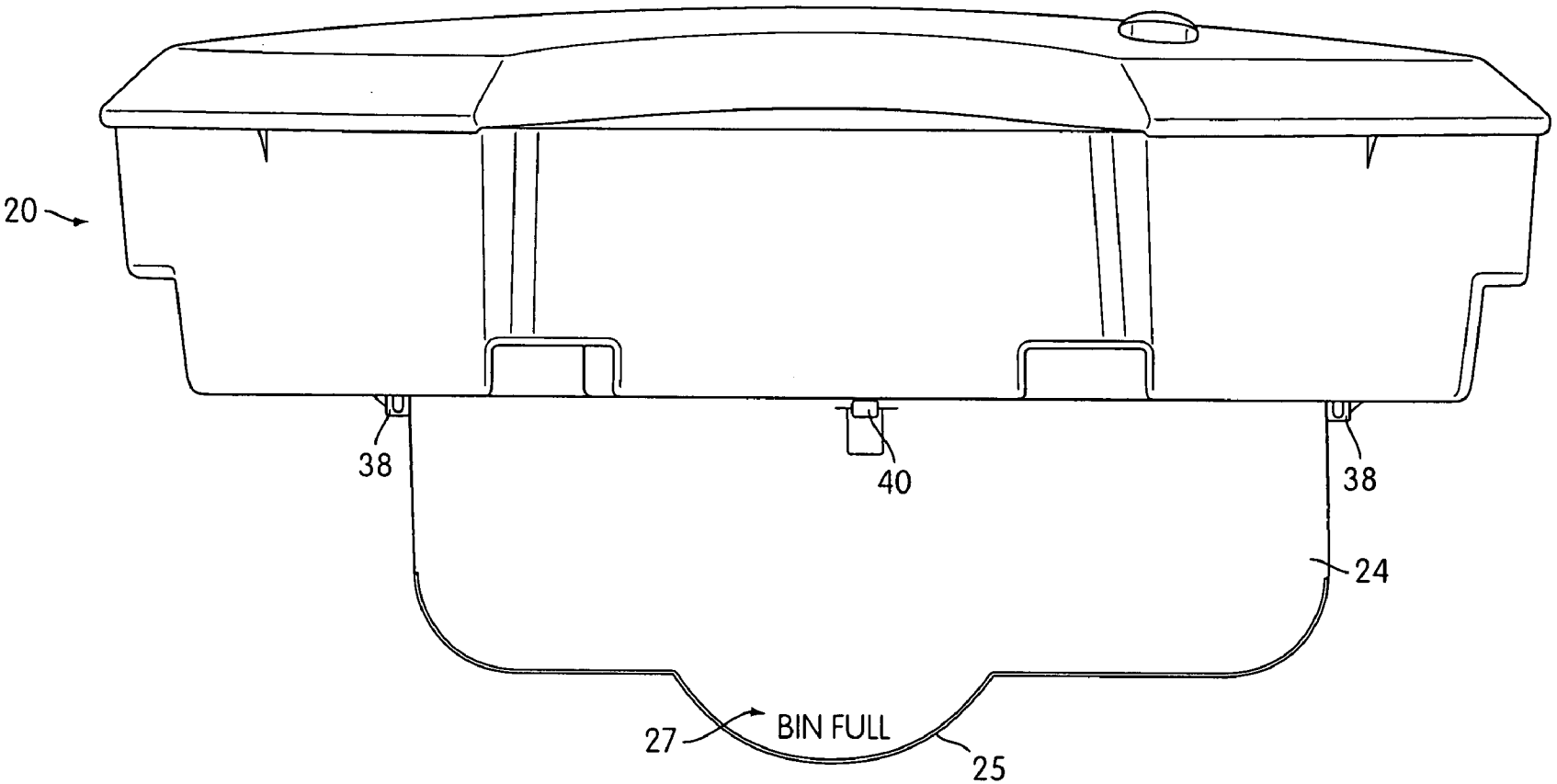
FIG. 4 is a side view of a shredder housing in accordance with an embodiment of the present invention.

In accordance with an embodiment of the present invention, a flap 24 is provided and is pivotally attached to the bin side (underside) of the shredder housing 20 between the output opening 43 of the shredder housing 20 and the bin access opening 34. Pivotal attachment may include a simple pivotal attachment about a pivot axis, or an attachment for compound movement that may include multiple axes or other types of movement (such as linear movement). Such attachment may be implemented by means of hinges 38 and/or hook 40. The flap 24 is configured to rotate freely about the hinges 38 and/or hook 40 when not impinged by any other forces. As such, when the shredder housing 20 is placed upon the bin 22 and the bin 22 is empty, the flap 24 is in a first position in which it hangs freely under gravity from the shredder housing 20 in a downward direction, as shown in FIG. 4.

As the bin 22 becomes full of paper and/or other materials, the contents will begin to push against the flap 24 from the shredder side of the flap 24 and towards the bin access opening 34 (or other viewable location; e.g., a window, as discussed above). The accumulation of shredded materials will eventually be enough to push and rotate the flap 24 to a second position, shown in FIGS. 1 and 2, which may be approximately ninety degrees from the first position (FIG. 4). In this position, at least a portion of the flap 24 becomes visible from the input side (i.e., exterior) of the shredder housing 20 through the bin access opening 34.

Figure 5:
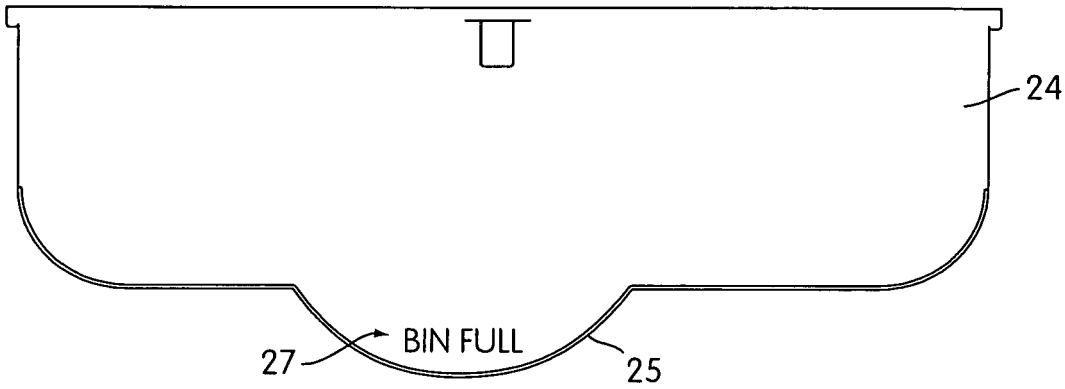
FIG. 5 is a front view of a full bin indicator flap in accordance with an embodiment of the present invention.

The flap 24 may be provided with an extension 25 so as to increase visibility through the bin access opening 34. The extension 25 or another part of the flap 24 visible through the bin access opening 34 may have indicia 27 thereon, such as the words "BIN FULL" (see FIGS. 4–5) or an easily noticeable color (e.g., red, yellow, or orange), in order to alert a user that the bin 22 is full. The extension 25 may alternatively be sized to completely cover the bin access opening 34 in order to prevent the insertion of further articles when the bin 22 is full. In embodiments where no bin access opening 34 or viewing window is present, the extension 25 may be a flag or other element that is mechanically connected to the flap 24 and passes through a slot in the shredder housing 20 to become visible (or alter its appearance) to a user.

Figure 3:
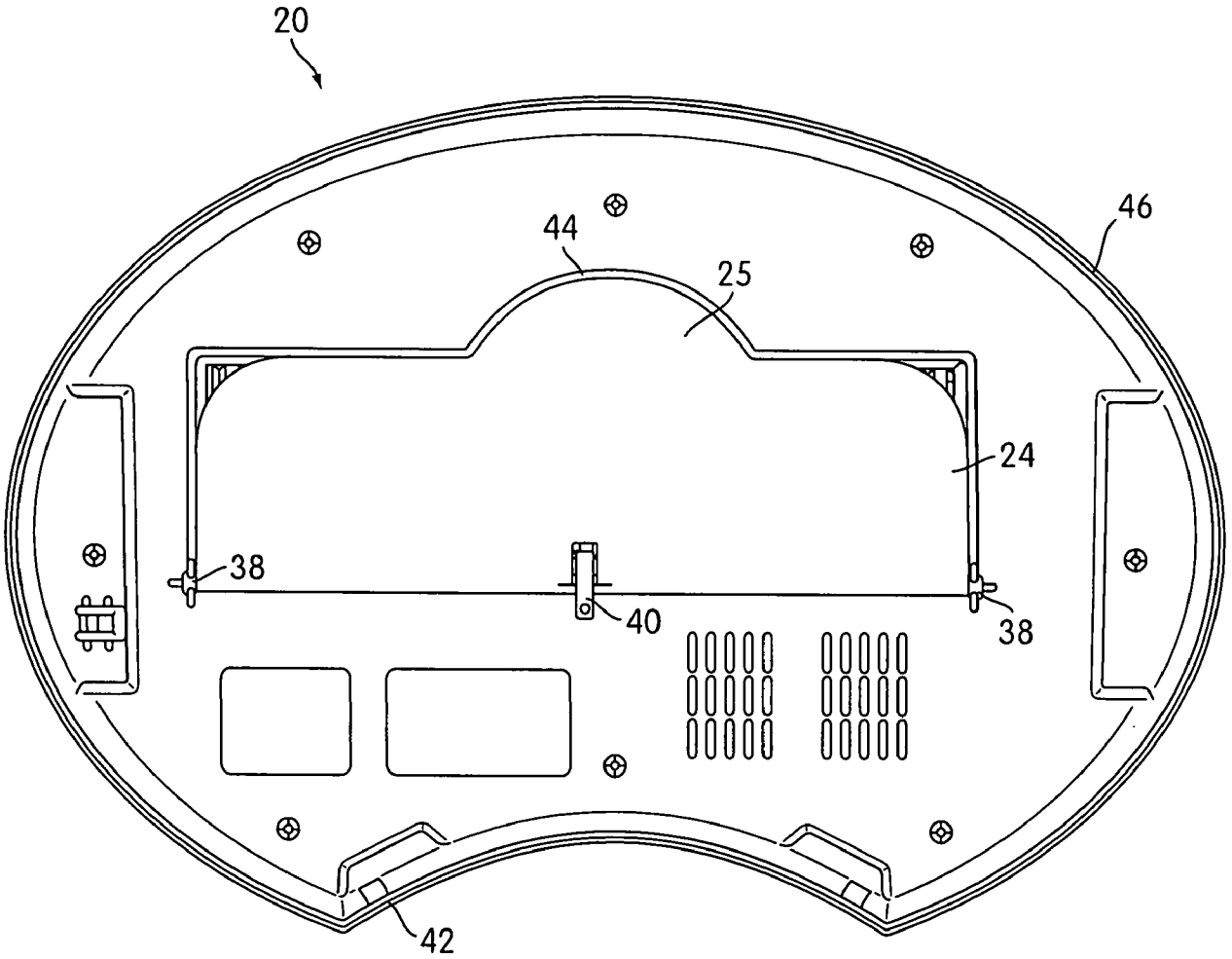
FIG. 3 is a bottom view of a shredder housing in a second configuration in accordance with an embodiment of the present invention.

As shown in FIGS. 2–3, the output side of the shredder housing 20 may be provided with a recess 44 that is sized and shaped to correspond to the flap 24 and any extension 25. The recess 44 is suitable for allowing the flap 24 to be flush with the shredder housing surface during storage and/or transport. If the flap 24 is positioned in proximity of the output opening 43 of the shredder machinery 42 and the recess 44 is positioned around the output 43, the flap 24 may be pivoted into position in the recess 44 to provide suitable protection from and for the sharp components of the shredder machinery 42, as shown in FIG. 3.

Accordingly, a completely mechanical (with no electronic components aside from the shredding mechanism) indicator is provided to notify a user when the contents of a shredder bin 22 should be emptied. Failure by a user to recognize that a bin 22 is full may result in overfilling, jamming, a paper mess, or other hazardous condition.

While specific embodiments have been described above, it will be appreciated that the subject of the present disclosure may be practiced otherwise than as described. The descriptions above are intended to be illustrative, not limiting. Thus, it will be apparent to one skilled in the art that modifications may be made without departing from the scope of the claims set out below.

What is claimed is:

1. A shredder apparatus, comprising:

a bin for receiving shredded materials;

a shredder housing having a shredder mechanism mounted therein, the shredder housing being provided on the bin and comprising an input opening on an upper side for receiving materials to be shredded and an output opening on a lower side for depositing shredded material into the bin; and a movable member movably connected to the shredder housing and extending into the bin, the movable member being positioned such that an accumulation of shredded material in the bin engages the movable member and moves it in an indicating direction, wherein the movable member has a mechanical visual indicator associated therewith, and wherein movement of the movable member in the indicating direction by the accumulation of shredded material moves the visual indicator in view of a user exterior of the shredder apparatus to visually indicate the accumulation to the user.

2. The shredder apparatus of claim 1, wherein the movable member is configured to rotate between a first position in which the movable member hangs freely from the lower side of the shredder housing, and a second position in which the movable member is rotated from the first position such that the visual indicator is viewable by a user.

3. The shredder apparatus of claim 1, wherein the visual indicator has indicia thereon, the indicia being visible when the movable member is moved by the accumulation of shredded materials.

4. The shredder apparatus of claim 1, wherein the movable member has an extension portion thereon to increase visibility of the visual indicator.

5. The shredder apparatus of claim 1, wherein a recess is formed in the lower side of the shredder housing for accommodating the movable member.

6. The shredder apparatus of claim 1, wherein the visual indicator is viewable by a user through a bin access opening.

7. The shredder apparatus of claim 6, wherein the visual indicator, when viewable by a user, covers at least a portion of the bin access opening.

8. The shredder apparatus of claim 1, wherein the visual indicator is viewable by a user through a window in the bin, the shredder housing, or both.

9. The shredder apparatus of claim 1, wherein the visual indicator is viewable by a user after the movable member, or a portion thereof, or the visual indicator, or a portion thereof, passes through the shredder housing.

10. A shredder apparatus, comprising:

a shredder mechanism;

a housing containing the shredder mechanism, the housing having an input opening on an upper side for receiving materials to be shredded and an output opening on a lower side for depositing shredded material; and a movable member movably connected to the shredder housing, the movable member being positioned such that an accumulation of shredded material engages the movable member and moves it in an indicating direction, wherein the movable member has a mechanical visual indicator associated therewith, and wherein movement of the movable member in the indicating direction by the accumulation of shredded material moves the visual indicator in view of a user exterior of the shredder apparatus to visually indicate the accumulation to the user.

11. The shredder apparatus of claim 10, wherein the visual indicator has indicia thereon to provide an alert to a user.

12. The shredder apparatus of claim 10, wherein the movable member is configured to rotate between a first position in which the movable member hangs freely from the lower side of the shredder housing, and a second position in which the movable member is rotated from the first position such that the visual indicator is viewable by a user.

13. The shredder apparatus of claim 10, wherein the movable member has an extension portion thereon to increase visibility of the visual indicator.

14. The shredder apparatus of claim 10, wherein a recess is formed in the lower side of the shredder housing for accommodating the movable member.

15. The shredder apparatus of claim 10, wherein the visual indicator is viewable by a user through a bin access opening.

16. The shredder apparatus of claim 15, wherein the visual indicator, when viewable by a user, covers at least a portion of the bin access opening.

17. The shredder apparatus of claim 10, wherein the visual indicator is configured to be viewable by a user through a window in a bin, the shredder housing, or both.

18. The shredder apparatus of claim 10, wherein the visual indicator is viewable by a user after the movable member, or a portion thereof, or the visual indicator, or a portion thereof, passes through the shredder housing.

19. A method for indicating accumulation of shredded material from a shredder in a bin, the method comprising:

feeding material to be shredded into an input opening in a housing of the shredder;

shredding the fed material with a shredding mechanism in the shredder housing;

depositing the shredded material into the bin with the shredded material accumulating therein;

the accumulating shredded material engaging a movable member movably mounted to the shredder housing and extending into the bin to move the movable member in an indicating direction;

wherein the movable member has a visual member associated therewith, and wherein movement of the movable member in the indicating direction by the accumulation of shredded material moves the visual indicator to visually indicate the accumulation to a user.

* * * * *